US008818583B2

(12) United States Patent
Iga et al.

(10) Patent No.: US 8,818,583 B2
(45) Date of Patent: Aug. 26, 2014

(54) TRAIN CREW SUPPORT DEVICE INCLUDING A DOOR OPENING-CLOSING DEVICE

(75) Inventors: Kazuhiro Iga, Tokyo (JP); Seisaku Tate, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 986 days.

(21) Appl. No.: 12/933,776

(22) PCT Filed: Mar. 19, 2009

(86) PCT No.: PCT/JP2009/055485
§ 371 (c)(1),
(2), (4) Date: Sep. 21, 2010

(87) PCT Pub. No.: WO2009/130961
PCT Pub. Date: Oct. 29, 2009

(65) Prior Publication Data

US 2011/0029166 A1 Feb. 3, 2011

(30) Foreign Application Priority Data

Apr. 21, 2008 (JP) ..... 2008-110560

(51) Int. Cl.
*G06F 7/00* (2006.01)

(52) U.S. Cl.
USPC ..... 701/19; 246/127

(58) Field of Classification Search
USPC ..... 701/19, 20, 34, 49, 23, 24, 36, 48, 117; 246/62, 125, 126, 127, 304, 3, 4, 5, 14, 246/15, 27, 174; 104/30; 187/391, 393; 105/341, 425; 49/358
See application file for complete search history.

(56) References Cited

U.S. PATENT DOCUMENTS 3,884,437 A * 5/1975 Linderman ..... 246/63 C
3,892,377 A * 7/1975 Hathaway ..... 246/62
4,269,377 A * 5/1981 Rush et al. ..... 246/182 B (Continued)

FOREIGN PATENT DOCUMENTS

CN 1843823 A 10/2006
EP 0 855 324 7/1998

(Continued)

OTHER PUBLICATIONS

International Search Report (PCT/ISA/210) issued on Jun. 23, 2009, by Japanese Patent Office as the International Searching Authority for International Application No. PCT/JP2009/055485.

(Continued)

*Primary Examiner* — Thomas Black
*Assistant Examiner* — Sze-Hon Kong
(74) *Attorney, Agent, or Firm* — Buchanan Ingersoll & Rooney PC

(57) ABSTRACT

A train classification information interface receives train classification information, an ATS interface obtains ATS control information transmitted by an ATS system, a memory unit stores therein the train classification information, an operation determining unit determines the door opening-closing side based on a door opening information table stored in the memory unit, and door opening-closing-signal outputting units output a door opening-closing signal to door opening-closing devices, respectively, based on a door opening-closing operation performed by a crew member and based on a signal output by the operation determining unit.

12 Claims, 8 Drawing Sheets

(56) References Cited

U.S. PATENT DOCUMENTS

| | | | | | |
|---|---|---|---|---|---|
| 4,327,415 | A | * | 4/1982 | Rush et al. | 701/117 |
| 4,361,300 | A | * | 11/1982 | Rush | 246/5 |
| 4,651,317 | A | * | 3/1987 | Tashiro et al. | 370/216 |
| 5,364,047 | A | * | 11/1994 | Petit et al. | 246/122 R |
| 5,390,880 | A | * | 2/1995 | Fukawa et al. | 246/167 R |
| 5,613,654 | A | * | 3/1997 | Gellermann et al. | 246/182 B |
| 5,947,423 | A | * | 9/1999 | Clifton et al. | 246/62 |
| 5,995,881 | A | * | 11/1999 | Kull | 701/20 |
| 6,135,396 | A | * | 10/2000 | Whitfield et al. | 246/182 R |
| 6,341,563 | B1 | * | 1/2002 | Gal et al. | 104/28 |
| 6,580,219 | B1 | * | 6/2003 | Jones et al. | 315/80 |
| 6,876,907 | B2 | * | 4/2005 | Kanner et al. | 701/19 |
| 7,099,754 | B2 | * | 8/2006 | Sugita et al. | 701/19 |
| 7,188,057 | B2 | * | 3/2007 | Birkelbach et al. | 703/7 |
| 7,201,350 | B2 | * | 4/2007 | Sugita et al. | 246/122 R |
| 7,206,676 | B2 | * | 4/2007 | Cross et al. | 701/19 |
| 7,213,369 | B2 | * | 5/2007 | Freeman | 49/358 |
| 7,618,011 | B2 | * | 11/2009 | Oleski et al. | 246/167 R |
| 7,756,613 | B2 | * | 7/2010 | Katsuta et al. | 701/19 |
| 2003/0070576 | A1 | * | 4/2003 | Vincent-Genod | 104/30 |
| 2005/0128064 | A1 | * | 6/2005 | Riesebosch | 340/457 |
| 2005/0251337 | A1 | * | 11/2005 | Rajaram | 701/301 |
| 2007/0100517 | A1 | * | 5/2007 | Kim | 701/19 |
| 2008/0036578 | A1 | * | 2/2008 | Toyama | 340/426.1 |
| 2008/0237406 | A1 | * | 10/2008 | Saito et al. | 246/124 |
| 2008/0259160 | A1 | * | 10/2008 | Morimitsu et al. | 348/148 |
| 2011/0184621 | A1 | * | 7/2011 | Bock et al. | 701/70 |

FOREIGN PATENT DOCUMENTS

| | | | | |
|---|---|---|---|---|
| JP | 50-032608 | A | | 3/1975 |
| JP | 61-275055 | A | | 12/1986 |
| JP | 8-182120 | A | | 7/1996 |
| JP | 10-273048 | A | | 10/1998 |
| JP | 2002-205640 | A | | 7/2002 |
| JP | 2002-321618 | A | | 11/2002 |
| JP | 2004-330797 | | | 11/2004 |
| JP | 2007-001346 | | | 1/2007 |
| JP | 2007-015574 | A | | 1/2007 |
| JP | 2007-302205 | A | | 11/2007 |
| JP | 2009126382 | A | * | 6/2009 |
| JP | 2012171455 | A | * | 9/2012 |
| TW | 303329 | | | 4/1997 |

OTHER PUBLICATIONS

Written Opinion (PCT/ISA/237) issued on Jun. 23, 2009, by Japanese Patent Office as the International Searching Authority for International Application No. PCT/JP2009/055485.

Chinese Office Action dated Aug. 29, 2012, issued in corresponding Chinese Patent Application No. 200980114728.4. (5 pages).

Office Action (Decision of a Patent Grant) dated Jun. 12, 2012, issued by the Japanese Patent Office in the corresponding Japanese Patent Application No. 2010-509117 and an English translation of Office Action. (5 pages).

* cited by examiner

200

| 201 STATION CODE | | 202 TRACK CODE | | 203 PLATFORM INFORMATION | | 204 DOOR OPENING SIDE | | 205 PLATFORM TRAIN-CAR CAPACITY |
|---|---|---|---|---|---|---|---|---|
| | | | | | | | | |
| | | | | | | | | |
| 00n | STATION N | 00001 | 1L | 001 | H1 | 1 | LEFT | 10 CARS |
| 00n | STATION N | 00002 | 2L | 002 | H2 | 2 | RIGHT | 6 CARS |
| 00n | STATION N | 00003 | 1R | 003 | H3 | 2 | RIGHT | 10 CARS |
| 00n | STATION N | 00004 | 2R | 002 | H2 | 1 | LEFT | 6 CARS |
| | | | | | | | | |

TRAIN CREW SUPPORT DEVICE INCLUDING A DOOR OPENING-CLOSING DEVICE

TECHNICAL FIELD

The present invention relates to a train crew support device for supporting train crew in performing a door opening-closing operation.

BACKGROUND ART

Conventionally, a train crew support device disclosed in, for example, Patent Literature 1 mentioned below is configured in such a way that, upon arrival of a train at a station platform, information regarding the door opening side transmitted from a ground device installed at the platform or the like is received for identifying the door opening side. Herein, for example, consider a case when disruption occurs to train services while trains are moving and train traffic rescheduling is performed so that a train is forced to make a temporary stop at a station not being a scheduled stop. In such a case, even if a crew member performs incorrect manipulation of a door opening switch provided on a cab, the configuration is such that the doors do not open unless the information regarding the door opening side is consistent with the manipulation.

Patent Literature 1: Japanese Patent Application Laid-open No. 2002-205640

DISCLOSURE OF INVENTION

Problem to be Solved by the Invention

However, since the ground device is highly expensive, the installment thereof gets confined only to interlocking stations. That makes it difficult to support the train crew in performing the door opening-closing operation at all stations.

Moreover, even in the case of installing the ground devices at interlocking stations, if train traffic rescheduling is performed just before a train makes a stop; then the information regarding the door opening side might be received after the train has stopped at a station. That makes it difficult for the crew members to swiftly direct the passengers.

The present invention has been made in view of the above and it is an object of the present invention to provide a train crew support device that enables obtaining information regarding the door opening side in a prompt manner without having to install ground devices.

Means For Solving Problem

A train crew support device according to an aspect of the present invention is equipped with a door opening-closing signal output unit for controlling a door opening-closing device of a train in response to a door opening-closing operation performed by a crew member, the train crew support device includes: a train classification information interface that imports train classification information that includes a station code indicating a stop, a track code indicating a train track, platform information indicating a platform direction, a door opening-closing side, and a platform train-car capacity; an ATS interface that imports, from an ATS system, ATS control information that includes a line code indicating a traveling line of a train, a station code, and a track code; a memory unit that stores the train classification information; and an operation determining unit that checks the line code, the station code, and the track code included in the ATS control information against the train classification information, identifies a door opening side of corresponding train, and outputs a door opening-closing signal to the door opening-closing signal output unit.

Effect Of The Invention

According to an aspect of the present invention, since ATS control information transmitted from an existing ATS system includes line codes, station codes and track codes; information regarding the door opening side can be obtained in a prompt manner without having to install ground devices.

EXPLANATIONS OF LETTERS OR NUMERALS

Figures 1, 2:
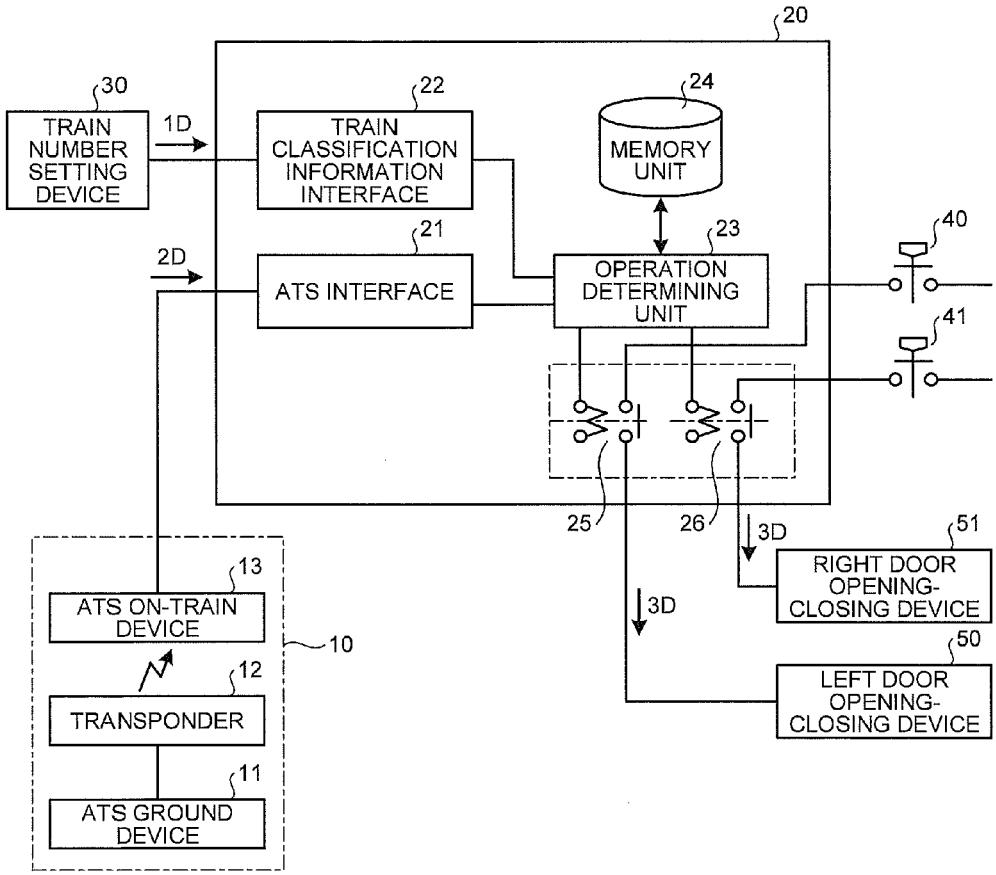
FIG. 1 is a diagram of an exemplary configuration of a train crew support device according to a first embodiment and exemplary configurations of devices connected to the train crew support device.
FIG. 2 is a diagram illustrating contents of a door opening information table.

10 ATS system
ATS ground device
12, S1, S2, S3, S4, S5, S6 Transponder
13 ATS on-train device
20, 20*a* Train crew support device
21 ATS interface
22 Train classification information interface
23, 23*a* Operation determining unit
24, 24*a* Memory unit
25, 25*a* Left-door opening-closing-signal output unit
26, 26*a* Right-door opening-closing-signal output unit
27, 27*a* Transmitting unit
28, 28*a* Train information providing device interface
30 Train number setting device
40 Left door opening switch
41 Right door opening switch
50, 50*a* Left door opening-closing device
51, 51*a* Right door opening-closing device
70, 70*a* Train information providing device
71, 71*a* Passenger compartment indicator
100 Transmission path
200 Door opening information table
201, 313, 618 Station code

202, 314, 617 Track code
203 Platform information
204 Door opening side
205 Platform train-car capacity
300*a*, 600*a* ATS control information contents
300*b* Individual information regarding divergence velocity limitation
300*c* Post-revision individual information regarding divergence velocity limitation
301, 601 Synchronization flag
302, 602 Information type
303, 603 Driving direction
304, 604 Track antenna number
305, 605 Individual information
306, 606 CRC
307, 607 Termination flag
308, 608, 611, 616 Free space
309 Limiting velocity
310 Limiting zone length
311 Distance to turnout
312, 619 Line code
401 Home signal
600*b* Individual information regarding stop aspect
600*c* Post-revision individual information regarding stop aspect
609 Divergence pattern continuance
610 Aspect code
612 Signal pattern correction
613 Maintenance information
614 Distance to home signal
615 Distance to subsequent turnout
1D Train classification information
2D ATS control information
3D Door opening-closing signal
1L Normal track
2L Reverse track
1R Normal track
2R Reverse track
A Train
H1, H2, H3, H4 Platform

BEST MODE(S) FOR CARRYING OUT THE INVENTION

Exemplary embodiments of a train crew support device according to the present invention are described in detail below with reference to the accompanying drawings. The present invention is not limited to these exemplary embodiments.

First Embodiment

FIG. 1 is a diagram of an exemplary configuration of a train crew support device 20 according to a first embodiment and exemplary configurations of devices connected to the train crew support device 20. To the train crew support device (hereinafter, simply referred to as "support device") 20, it is possible to connect an ATS system 10, a train number setting device (hereinafter, simply referred to as "trn-num setting device") 30, a left door opening switch 40 (hereinafter, simply referred to as "switch 40"), a right door opening switch 41 (hereinafter, simply referred to as "switch 41"), a left door opening-closing device 50, and a right door opening-closing device 51.

FIG. 2 is a diagram illustrating contents of a door opening information table. A door opening information table (hereinafter, simply referred to as "table") 200 includes items such as station code 201, track code 202, platform information 203, door opening side 204, and platform train-car capacity 205.

The station code 201 indicates the stops. The track code 202 indicates the travelling directions of trains. For example, besides indicating the tracks along the up line and the down line, the track code 202 can also indicate the tracks diverging at shunts (points). The platform information 203 indicates platform numbers in a corresponding manner to the track code 202. The door opening side 204 indicates the sides of open doors in a corresponding manner to the track code 202 and the platform information 203. The platform train-car capacity 205 indicates the number of train cars that can stop along each platform. Although codes such as "1L" are specified in the right column of the track code 202 in FIG. 2, binary codes are registered in the actual table 200, as illustrated in the left column of each code.

With reference to FIG. 1, the support device 20 includes an ATS interface 21, a memory unit 24, a left-door opening-closing-signal output unit 25 (hereinafter, simply referred to as "left door opening-closing unit), a right-door opening-closing-signal output unit 26 (hereinafter, simply referred to as "right door opening-closing unit), and an operation determining unit 23.

The trn-num setting device 30 is a device for setting train classification information. For example, train classification information 1D includes the station code 201, the track code 202, the platform information 203, the door opening side 204, the platform train-car capacity 205, number of train cars, train numbers, train types, starting stations, destinations, stops, and arrival time and departure time at those stops. Although the installation location of the trn-num setting device 30 differs for each railway company, it is common practice to install it in a crew member monitoring device on the cab. At the beginning of working, the train classification information 1D is stored in a recording medium such as an IC card and is retrieved for use with a reading device disposed in a train.

An ATS on-train device 13 can receive, from a transponder 12 installed on the line, information (hereinafter, referred to as "control information") 2D regarding stop signals, velocity limitation locations, distances, and the like. The transponder 12 is controlled by an ATS ground device (hereinafter, simply referred to as "ground device") 11 and is configured to wirelessly transmit information to the trains passing thereabove. Meanwhile, the ground device 11, the transponder 12, and the ATS on-train device 13 are hereinafter collectively referred to as the ATS system 10. As the ATS system 10, a pattern generating ATS system 10 is used that performs velocity control by generating a velocity check pattern (a curved line representing velocity variation from the start of braking to attainment of a halting state).

The switch 40 and the switch 41 are installed in a crew member operation panel and are used by a crew member to open the doors on the left side or on the right side when the train makes a stop at a platform.

The left door opening-closing device 50 and the right door opening-closing device 51 are devices that perform opening-closing control of the doors in each train car in accordance with a manipulation of the switch 40 and the switch 41, respectively.

An information interface 22 is able to import the train classification information 1D that has been transmitted by the trn-num setting device 30. Besides, for example, the information interface 22 includes a connection port for LAN or RS422. The transmission control procedure is desirable to make use of TCP/IP for LAN; and it is desirable to make use of HDLC for RS422, for example. However, the configuration is not limited to those cases.

The memory unit 24 can store therein the train classification information 1D that has been transmitted by the information interface 22. Besides, the memory unit can also store therein, based on the train classification information 1D, the table 200 that includes the station code 201, the track code 202, the platform information 203, the door opening side 204, the platform train-car capacity 205 in a corresponding manner.

The ATS interface 21 can import the control information 2D that has been detected by the ATS on-train device 13.

The operation determining unit 23 receives the control information 2D from the ATS interface 21, checks the control information 2D against the table 200 stored in the memory unit 24, and outputs a signal for driving the left door opening-closing unit 25 or the right door opening-closing unit 26.

The left door opening-closing unit 25 or the right door opening-closing unit 26 is configured to output a door opening-closing signal 3D to the left door opening-closing device 50 or the right door opening-closing device 51, in the case when a crew member manipulates the switch 40 or the switch 41, and when conjunction is established between the signal transmitted by the switch 40 or the switch 41 and the signal transmitted by the operation determining unit 23. Therefore, when a crew member correctly performs the door opening-closing operation, the left door opening-closing unit 25 or the right door opening-closing unit 26 outputs the door opening-closing signal 3D, which corresponds to the switch 40 or the switch 41, to the left door opening-closing device 50 or the right door opening-closing device 51, respectively. However, if a crew member makes an error in performing the door opening-closing operation, then the door opening-closing signal 3D is not output and the left door opening-closing device 50 or the right door opening-closing device 51 do not perform opening-closing control. A coil-type relay circuit is used in the left door opening-closing unit 25 and the right door opening-closing unit 26 illustrated in FIG. 1; however, the configuration is not limited to that case.

With the abovementioned configuration, upon receiving information transmitted by the ATS system 10, the support device 20 according to the first embodiment is able to identify the door opening side 204 using the station code 201 stored in the table 200 as the key code.

Figure 3:
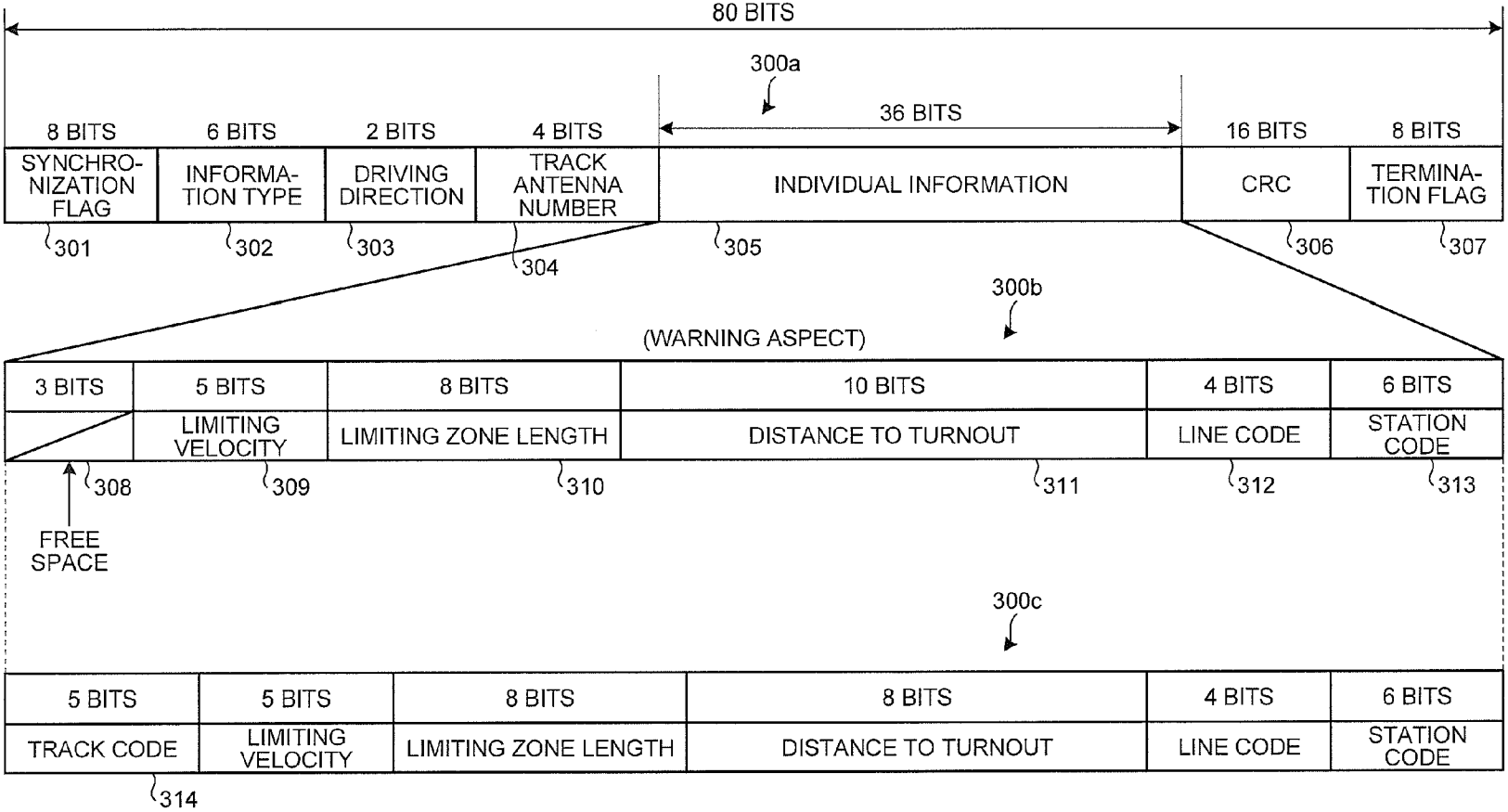
FIG. 3 is a diagram illustrating an example of contents of ATS control information.

FIG. 3 is a diagram illustrating an example of contents of the ATS control information 2D. In the upper part in FIG. 3, contents 300*a* of the control information 2D include a synchronization flag 301 (8 bits), an information type 302 (6 bits), a driving direction 303 (2 bits), a track antenna number 304 (34 bits), individual information 305 (36 bits), a CRC 306 (16 bits), and a termination flag 307 (8 bits) in that order from the left side.

The information type 302 indicates the types of information handled by the transponder 12. For example, a stop aspect or a warning aspect is assigned to the information type 302. Besides, as the velocity limitations assigned are a divergence velocity limitation, a curvilinear velocity limitation, a gradient velocity limitation, and a provisional velocity limitation are assigned. The CRC 306 (Cyclic Redundancy Check) is a code for detecting an error in data.

In the middle part in FIG. 3, the contents of individual information 300*b* are given for the case of divergence velocity limitation. The individual information 300*b* regarding the divergence velocity limitation includes free space 308 (3 bits), a limiting velocity 309 (5 bits), a limiting zone length 310 (8 bits), a distance to turnout 311 (10 bits), a line code 312 (4 bits), and a station code 313 (6 bits) in that order from the left side.

Herein, although the individual information 300*b* regarding the divergence velocity limitation includes the line code 312 and the station code 313, the support device 20 according to the first embodiment requires codes equivalent to the track code 202 in the table 200.

The free space 308 of 3 bits is available in the individual information 300*b* regarding the divergence velocity limitation. In the case of allocating that free space to the track code; it is necessary to secure 5 bits by taking into consideration, for example, large stations having many tracks.

10 bits are allotted to the distance to turnout 311. If the calculation is done with the minimum resolution of 4 mm intervals, it is possible to obtain up to the total distance of 4092 m (4*1023 patterns). Assuming that the actual velocity of a train is 130 km/h, it takes a distance of about 670 m to make a stop from that velocity upon application of the emergency brakes (in the case of usual deceleration of about 3.5 km/hr/sec). If the size of the distance to turnout 311 is changed to 8 bits; with the minimum resolution of 4 m, it is possible to obtain up to the travel distance of 1024 m (4*256 patterns) at the time of applying the emergency brakes. That is, in the ground device 11, by changing the size of the distance to turnout 311 to 8 bits and by allotting the remaining 2 bits to the free space 308, it becomes possible to allocate that free space to the track code. As a result, as illustrated in the lower part in FIG. 3, in post-revision individual information 300*c* regarding the divergence velocity limitation, it is possible to include the line code 312 and the station code 313 as well as a track code 314.

Figure 4:
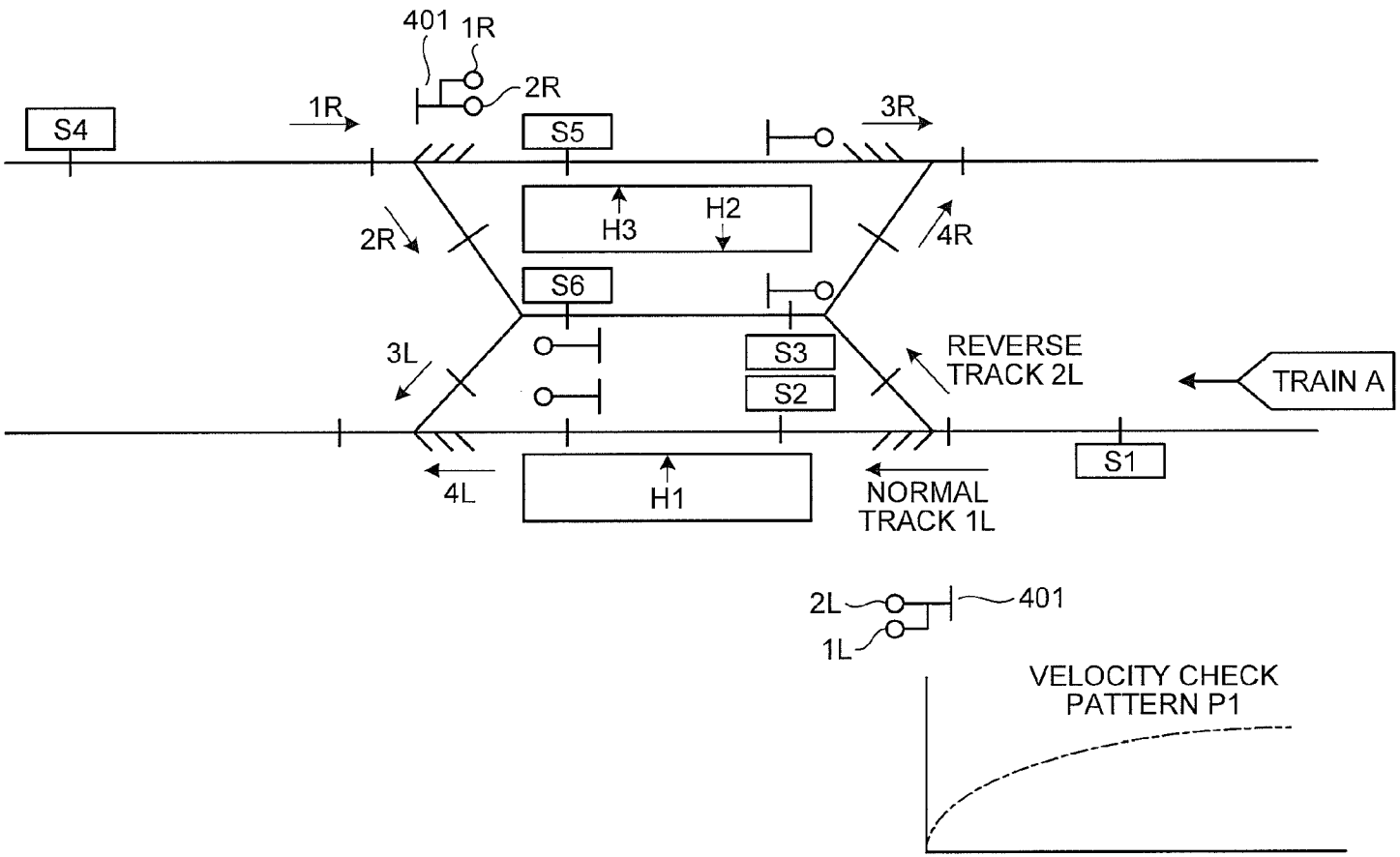
FIG. 4 is a schematic diagram of station yard wiring and a velocity check pattern P1 in an interlocking station.

Given below is the detailed description of operations performed by the support device 20 disposed at an interlocking station (i.e., at a station installed with a shunt). FIG. 4 is a schematic diagram of station yard wiring and a velocity check pattern P1 in an interlocking station. In FIG. 4, the passengers in a train A get off at a platform H1, a platform H2, or a platform H3. For example, if a train enters the station from the right side, the track thereof is a normal track 1L or a reverse track 2L; and if a train enters the station from the left side, the track thereof is a normal track 1R or a reverse track 2R.

The train A entering from the normal track 1L can make a stop at the platform H1. Moreover, the train A entering from the reverse track 2L or from the reverse track 2R can make a stop at the platform H2. Furthermore, the train A entering from the normal track 1R can make a stop at the platform H3. Meanwhile, the departure tracks from each platform for the train A are assumed to be a reverse track 3L, a normal track 4L, a normal track 3R, and a reverse track 4R.

In FIG. 4, the transponder 12 illustrated in FIG. 1 is disposed in plurality on each train line. Herein, transponders S1 and S4 are disposed as protection against advancing blindly against a home signal 401 and as protection against excessive velocity at the divergence crossing; while transponders S2, S3, S5, and S6 are disposed for performing platform halt control.

Assume that the train A moving in from the right side has the original travelling direction toward the platform H1, that is, on the normal track 1L, but train traffic rescheduling, which is performed while the train A is moving, has forced a change from the normal track 1L to the reverse track 2L. In that case, the home signal 401 that is installed in the vicinity of the shunt for the normal track 1L and the reverse track 2L indicates a stop aspect for the normal track 1L and a warning aspect for the reverse track 2L. Under that condition, when the train A passes over the transponder S1; the support device 20 receives the control information 2D containing the individual information 300*c* (warning aspect) via the ATS on-train device 13.

Upon receiving the control information 2D, the train A performs velocity control by creating the velocity check pattern P1 as illustrated in FIG. 4. Meanwhile, the operation determining unit 23 checks the control information 2D against the table 200 stored in the memory unit 24, and determines the station code 201, the track code 202, the platform information 203, the door opening side 204, and the platform train-car capacity 205. Thus, the door opening side 204 can be identified before arriving at the platform H2.

Herein, since the doors on the right side with respect to the travelling direction of the train A are to be opened, the operation determining unit 23 outputs a signal for driving the right door opening-closing unit 26. After the train A makes a stop and when the crew member presses the switch 41, conjunction is established thereby making it possible to output the door opening-closing signal 3D to the right door opening-closing device 51. Herein, even if the crew member mistakenly presses the switch 40, no conjunction is established and thus the left door opening-closing device 50 does not operate.

Figure 5:
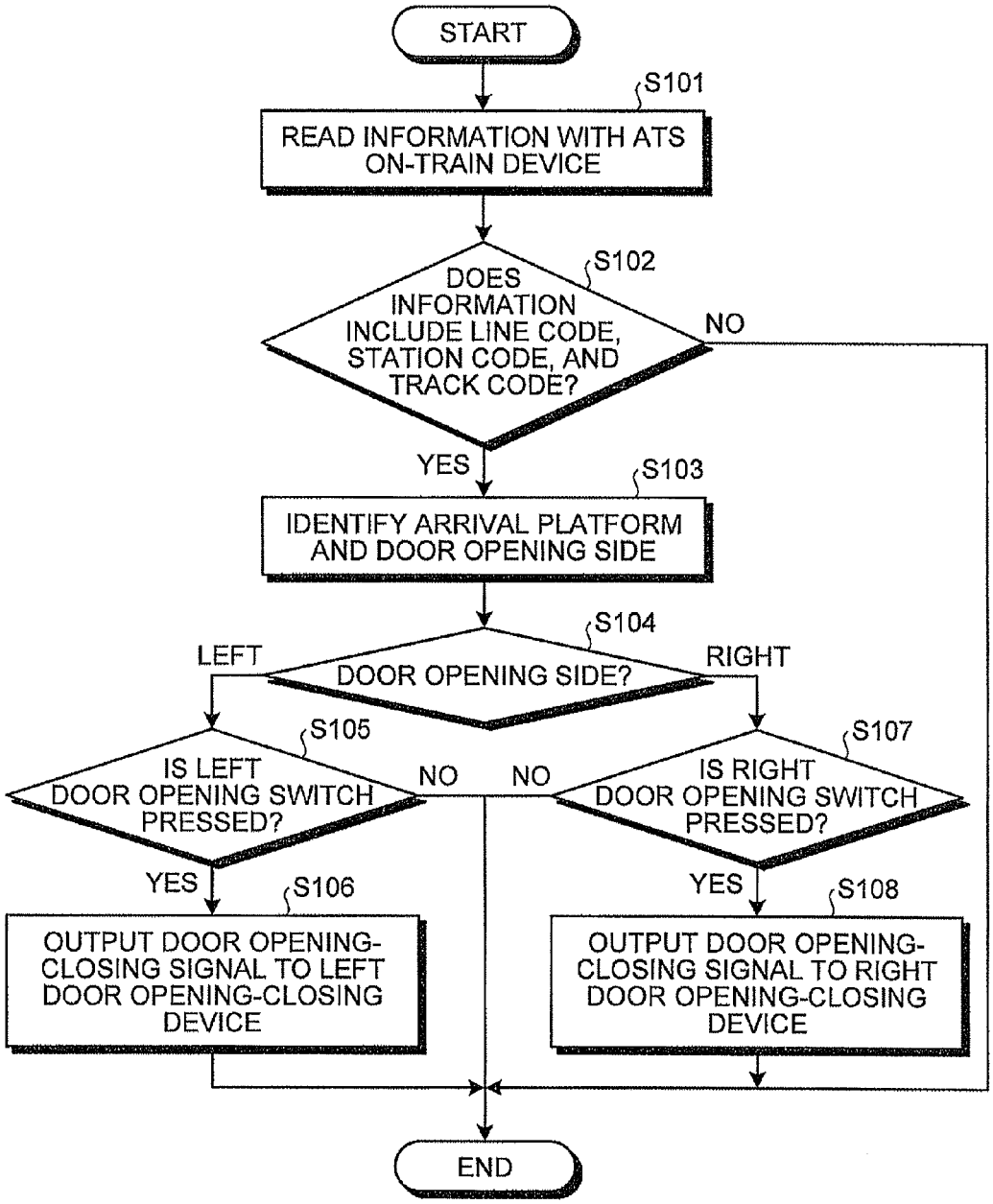
FIG. 5 is an exemplary flowchart explaining a flow for the case when the train crew support device decides on the door opening side.

FIG. 5 is an exemplary flowchart explaining a flow for the case when the train crew support device 20 decides on the door opening side. The support device 20 reads the control information 2D at a constant interval (Step S101). The operation determining unit 23 determines whether the line code 312, the station code 313, and the track code 314 are recorded in the control information 2D. If that information is recorded (Yes at Step S102), then the operation determining unit 23 calls the table 200 stored in the memory unit 24 and identifies the platform information 203 and the door opening side 204, which correspond to the station code 201 and the track code 202 in the table 200 (Step S103). When the identified door opening side 204 is the left side (Left at Step S104) and when the crew member has pressed the switch 40 (Yes at Step S105), the operation determining unit 23 outputs the door opening-closing signal 3D to the left door opening-closing device 50 (Step S106). On the other hand, when the identified door opening side 204 is the right side (Right at Step S104) and when the crew member has pressed the switch 41 (Yes at Step S107), the operation determining unit 23 outputs the door opening-closing signal 3D to the right door opening-closing device 51 (Step S108).

Meanwhile, if the line code 312, the station code 313, and the track code 314 are not recorded in the control information 2D (No at Step S102), then the operation determining unit 23 terminates the processing.

Moreover, when the identified door opening side 204 is the left side (Left at Step S104) but when the crew member has not pressed the switch 40 (No at Step S105), then the operation determining unit 23 terminates the processing without outputting the door opening-closing signal 3D. Similarly, when the identified door opening side 204 is the right side (Right at Step S104) but when the crew member has not pressed the switch 41 (No at Step S107), then the operation determining unit 23 terminates the processing without outputting the door opening-closing signal 3D.

As described above, the support device 20 according to the first embodiment receives the control information 2D, which includes the individual information 300*c* having the codes revised by the reliable and existing ground device 11, and checks the individual information 300*c* against the table 200. Hence, information regarding the door opening side can be received without having to install other ground devices. Moreover, even if train traffic rescheduling is performed just before a train makes a stop, the crew member can direct the passengers in a swift manner. Furthermore, it used to be the case that the train classification information set in a train at the beginning gets overwritten by the use of a ground device thereby making software processing a complex task. However, herein, such processing can also be eliminated.

Second Embodiment

In the support device 20 according to a second embodiment, a station code and a track code are assigned to the individual information for the case of a stop aspect.

Figure 6:
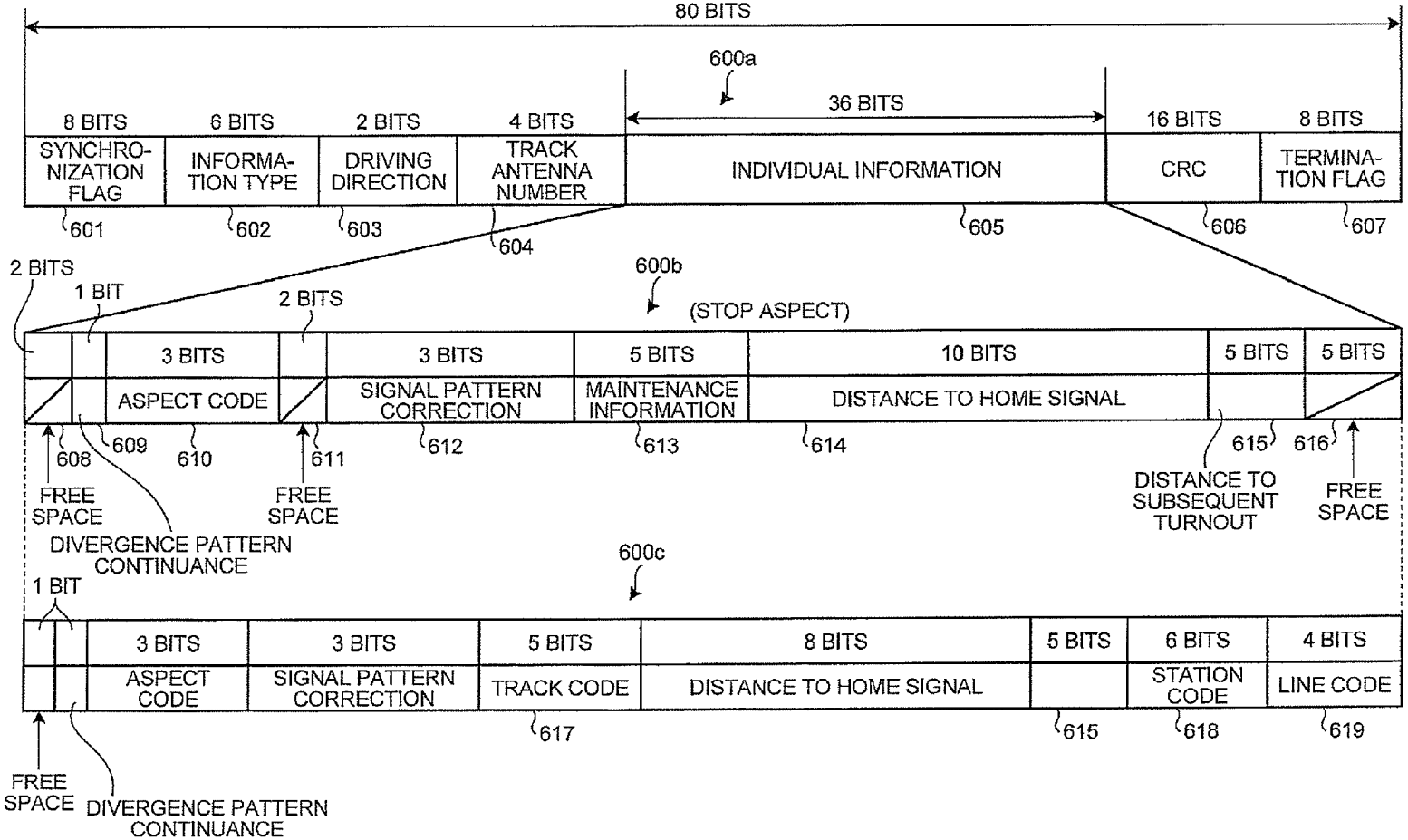
FIG. 6 is a diagram illustrating an example of contents of the ATS control information for the case of a stop aspect.

FIG. 6 is a diagram illustrating an example of contents of the control information 2D for the case of a stop aspect. In the upper part in FIG. 6, contents 600*a* of the control information 2D are identical to the contents 300*a* of the control information 2D illustrated in FIG. 3.

In the middle part in FIG. 6 are given the contents of individual information 600*b* regarding a stop aspect. The individual information 600*b* regarding a stop aspect includes free space 608 (2 bits), divergence pattern continuance 609 (1 bit), aspect code 610 (3 bits), free space 611 (2 bits), signal pattern correction 612 (3 bits), maintenance information 613 (5 bits), distance to home signal 614 (10 bits), distance to subsequent turnout 615 (5 bits), and free space 616 (5 bits) in that order from the left side. Herein, the divergence pattern continuance 609 is information indicating that, if divergence velocity limitation control is already underway, then it is to be continued.

Meanwhile, in the individual information 300*b* regarding the divergence velocity limitation, the free space 308 of 3 bits is available. In the case of allocating that free space to the track code, it is necessary to secure 5 bits by taking into consideration, for example, large stations having many tracks.

Herein, the support device 20 according to the second embodiment requires codes equivalent to the station code 201 and the track code 202 in the table 200 as well as requires a line code. Regarding the track code 202, the maintenance information 613 specified in the individual information 600*b* regarding a stop aspect corresponds to the track code 202. On the contrary, regarding a line code and a station code, it is necessary to add codes using the free space 608, the free space 611, and the free space 616.

The station code and the line code require 6 bits and 4 bits, respectively. Since the free space 608, the free space 611, and the free space 616 have a total of 9 bits; there is a shortage of 1 bit. In the individual information 600*b* regarding a stop aspect, 10 bits are allotted to the distance to home signal 614. Instead, similar to the abovementioned description, if 8 bits are allotted to the distance to home signal 614; then it becomes possible to secure 2 bits. By allotting those 2 bits among the free space 608, the free space 611, and the free space 616; it becomes possible to allocate that free space to the line code and the station code. Meanwhile, as described above, revision of the number of bits can be performed in the ground device 11. As a result, as illustrated in the lower part in FIG. 6, in post-revision individual information 600*c* regarding a stop aspect, it is possible to include line code 619, station code 618, and track code 617.

Given below with reference to FIG. 4 is the detailed description of operations performed by the support device 20. Herein, assume that the train A moving in from the right side has the original travelling direction toward the platform H1, that is, on the normal track 1L without being subjected to train traffic rescheduling while moving. In that case, the home signal 401 indicates a stop aspect for the normal track 1L. Under that condition, when the train A passes over the transponder S1; the support device 20 installed in the train A receives the control information 2D including the individual information 600*c* (stop aspect) via the ATS on-train device 13.

The operation determining unit 23 checks the control information 2D against the table 200 stored in the memory unit 24, and determines the station code 201, the track code 202, the platform information 203, the door opening side 204, and the platform train-car capacity 205.

Herein, since the doors on the left side with respect to the travelling direction of the train A are to be opened, the operation determining unit 23 outputs a signal for driving the left door opening-closing unit 25. After the train A makes a stop and when the crew member presses the switch 40, conjunction is established thereby making it possible to output the door opening-closing signal 3D to the left door opening-closing device 50.

Herein, even if the crew member mistakenly presses the switch 41, no conjunction is established and thus the right door opening-closing device 51 does not operate. Meanwhile, since the sequence of operations performed by the support device 20 is identical to the flowchart illustrated in FIG. 5, the explanation thereof is not repeated.

As described above, the support device 20 according to the second embodiment receives the control information 2D, which includes the individual information 600*c* having the codes revised by the reliable and existing ground device 11, and checks the individual information 600*c* against the table 200. Hence, even in the case of making a stop at a non-interlocking station or at a stop having no diversions; it becomes possible to obtain exit information, to direct the passengers in a swift manner, and to eliminate software processing without having to install ground devices.

Third Embodiment

The support device 20 according to a third embodiment is configured to transmit the train classification information 1D and the control information 2D received by it to a support device 20*a* installed in each train car.

Figure 7:
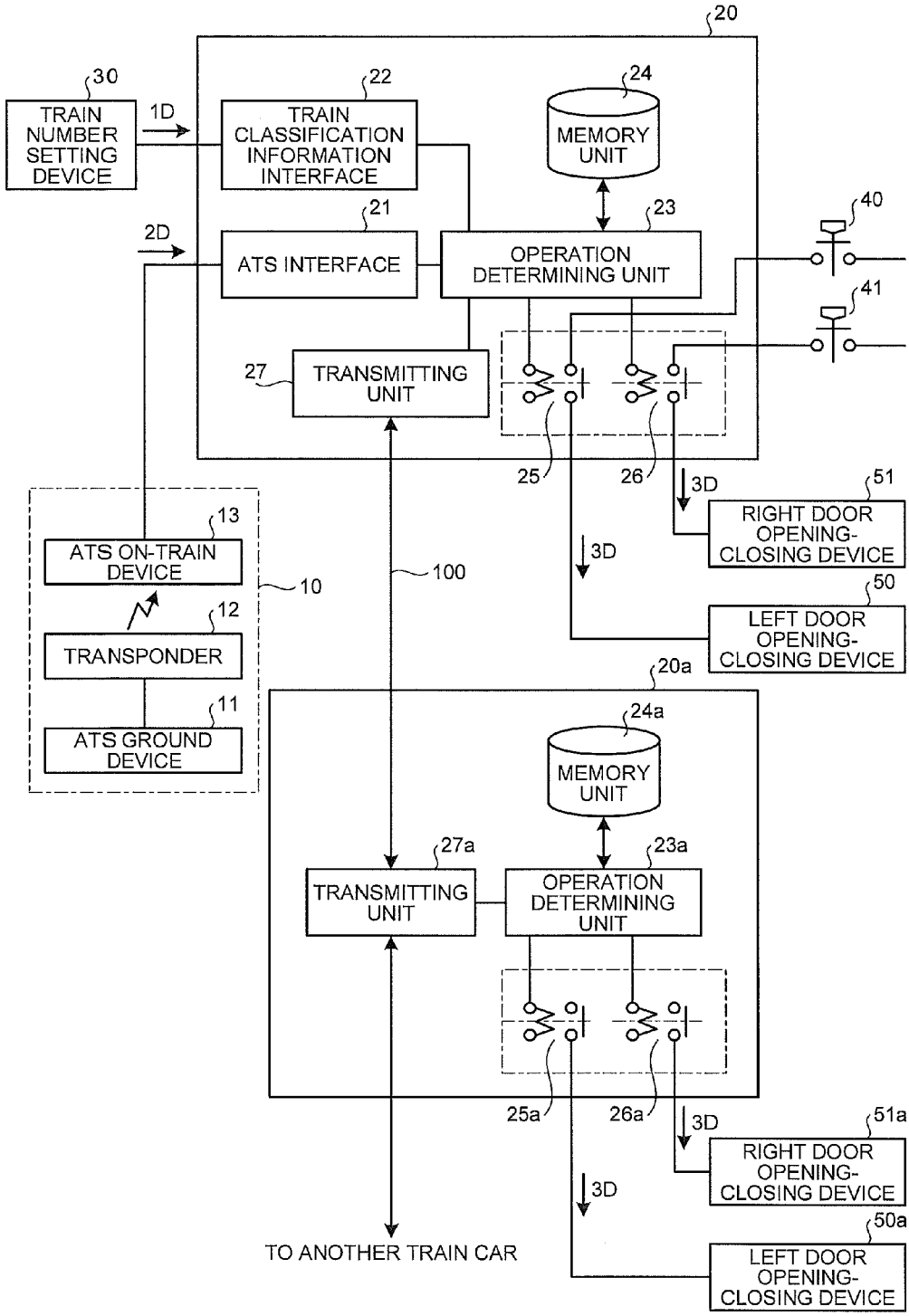
FIG. 7 is a diagram of an exemplary configuration of the train crew support device according to a third embodiment and exemplary configurations of devices connected to the train crew support device.

FIG. 7 is a diagram of an exemplary configuration of the train crew support device 20 according to the third embodiment and exemplary configurations of devices connected to the train crew support device 20. For example, the support device 20 is installed in the first train car and the support device 20*a* is installed in every other train car other than the first train car.

The support device 20 is configured by additionally disposing a transmitting unit 27 in the support device according to the first embodiment. The support device 20*a* includes a memory unit 24*a*, a left door opening-closing unit 25*a*, a right door opening-closing unit 26*a*, an operation determining unit 23*a*, and a transmitting unit 27*a*. As compared to the support device 20, the support device 20*a* does not include the information interface 22 and the ATS interface 21.

The transmitting unit 27 and the transmitting unit 27*a* are connected to a transmission path 100 that is laid across the train cars. For that reason, the train classification information 1D and the control information 2D imported by the support device 20 can be transmitted via the operation determining unit 23 to the operation determining unit 23*a* in the support device 20*a*. Besides, in addition to importing the train classification information 1D and the control information 2D from the support device 20, the transmitting unit 27*a* can also relay that information to another train car.

The table 200 stored in the memory unit 24 or the memory unit 24*a* includes the information regarding the platform train-car capacity 205. That enables the operation determining unit 23 to compare the length of a platform of a station (train car capacity) with the length of the train (number of train cars) making a stop. Then, for each train car, the operation determining unit 23 can determine whether the number of train cars is inside the train car capacity of that platform.

Figure 8:
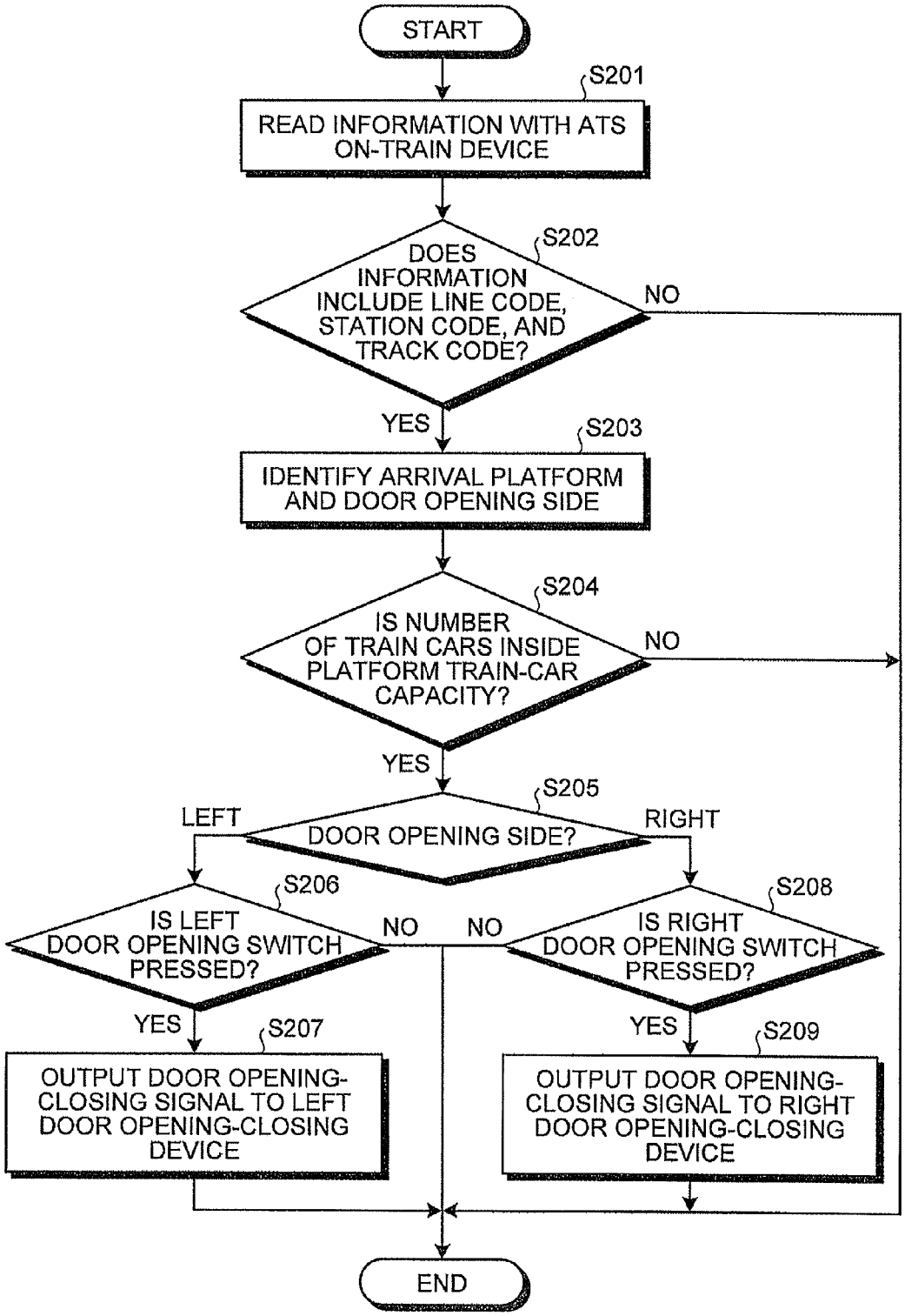
FIG. 8 is an exemplary flowchart explaining a flow for the case when the train crew support device and a train crew support device decide on the door opening side.

FIG. 8 is an exemplary flowchart explaining a flow for the case when the train crew support device 20 and the train crew support device 20*a* decide on the door opening side 204. Herein, as compared to the invention according to the first embodiment, the sequence of operations differs in that a step for determining the platform train-car capacity 205 is additionally performed. Meanwhile, although the following explanation is given with reference to the case of receiving the individual information 300*c* regarding the divergence velocity limitation, the explanation is also applicable to the case of receiving the individual information 600*c* regarding a stop aspect.

The support device 20 reads the control information 2D at constant intervals (Step S201). The operation determining unit 23 and the operation determining unit 23*a* determine whether the line code 312, the station code 313, and the track code 314 are recorded in the control information 2D. If that information is recorded (Yes at Step S202), then the operation determining unit 23 and the operation determining unit 23*a* call the table 200 stored in the memory unit 24 and the memory unit 24*a*, respectively, and identify the platform information 203 and the door opening side 204, which correspond to the station code 201 and the track code 202 in the table 200 (Step S203).

Subsequently, the operation determining unit 23 and the operation determining unit 23*a* determine whether the train cars are within the platform train-car capacity 205. When the car numbers in the train A are set in the ascending order (1, 2, n−1, n) from the travelling direction; if "car number"≤"platform train-car capacity 205" (Yes at Step S204), then the system control proceeds to Step S205. However, if "car number">"platform train-car capacity 205" (No at Step S204), then the processing is terminated.

When the car numbers in the train A are set in the descending order (n, n−1, 2, 1) from the travelling direction; if "number of train cars-car number"<"platform train-car capacity 205" (Yes at Step S204), then the system control proceeds to Step S205. However, if "number of train cars-car number"≥"platform train-car capacity 205" (No at Step S204), then the processing is terminated.

When the identified door opening side 204 is the left side (Left at Step S205) and when the crew member has pressed the switch 40 (Yes at Step S206), the operation determining unit 23 outputs the door opening-closing signal 3D to the left door opening-closing device 50 (Step S207). On the other hand, when the identified door opening side 204 is the right side (Right at Step S205) and when the crew member has pressed the switch 41 (No at Step S208), the operation determining unit 23 outputs the door opening-closing signal 3D to the right door opening-closing device 51 (Step S209).

Meanwhile, if the line code 312, the station code 313, and the track code 314 are not recorded in the control information 2D (No at Step S202), then the operation determining unit 23 terminates the processing.

Moreover, when the identified door opening side 204 is the left side (Left at Step S205) but when the crew member has not pressed the switch 41 (No at Step S206), then the operation determining unit 23 terminates the processing without outputting the door opening-closing signal 3D. Similarly, when the identified door opening side 204 is the right side (Right at Step S205) but when the crew member has not pressed the switch 40 (No at Step S208), then the operation determining unit 23 terminates the processing without outputting the door opening-closing signal 3D.

As described above, according to the support device 20 and the support device 20*a* in the third embodiment, the control information 2D having the revised codes is transmitted to the support device 20*a* installed in each train car. Therefore, in each train car, the control information 2D can be checked against the table 200. Hence, without having to install ground devices, it is possible to prevent accidental opening of doors of those train cars that are outside the train car capacity of the platform.

Fourth Embodiment

The support device 20 according to a fourth embodiment is configured in such a way that, upon receiving the control information, the passengers in the train are notified about the side at which the doors would open.

Figure 9:
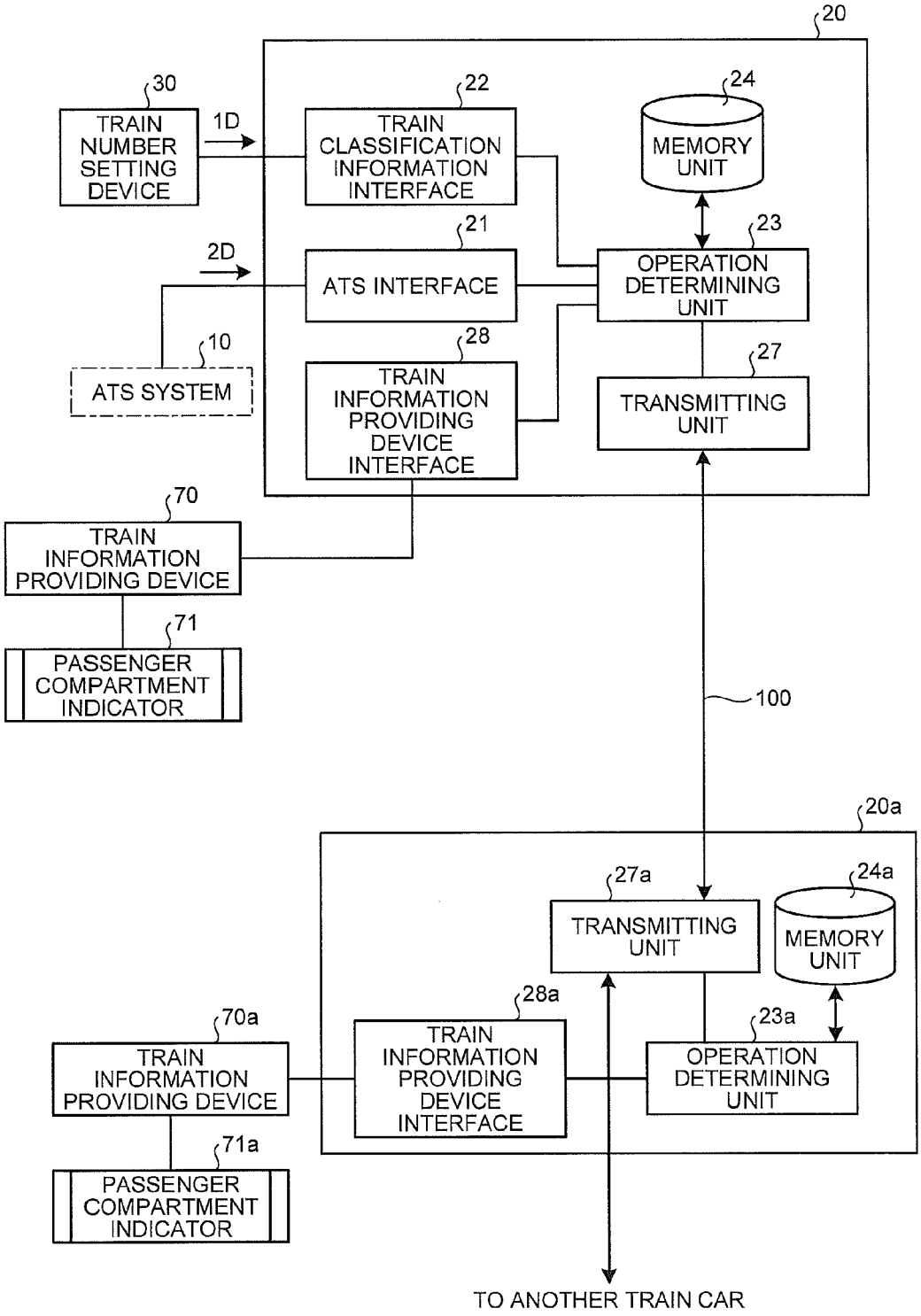
FIG. 9 is a diagram of an exemplary configuration of the train crew support device according to a fourth embodiment and exemplary configurations of devices connected to the train crew support device.

FIG. 9 is a diagram of an exemplary configuration of the train crew support device 20 according to the fourth embodiment and exemplary configurations of devices connected to the train crew support device 20.

The support device 20 is configured by additionally disposing a train information providing device interface (hereinafter, simply referred to as "interface") 28 in the support device according to the first embodiment.

The support device 20*a* includes the memory unit 24*a*, the operation determining unit 23*a*, the transmitting unit 27*a*, and an interface 28*a*. As compared to the support device 20, the support device 20*a* does not include the information interface 22 and the ATS interface 21.

Although the switch 40, the switch 41, the left door opening-closing device 50, and the right door opening-closing device 51 are not illustrated; each of the support device 20 and the support device 20*a* includes those elements in an identical manner to that in the first and the third embodiments.

A train information providing device 70 and a train information providing device 70*a* perform processing of station information and processing of expected time of arrival, and transmit the latest track information to a passenger compartment indicator 71 and a passenger compartment indicator 71*a*, respectively. Since the information regarding train operation can also be displayed on the passenger compartment indicator 71 and the passenger compartment indicator 71*a*, it is possible to inform, while the train is moving, the side at which the doors would open next time.

The interface 28 and the interface 28*a* are respectively connectable to the train information providing device 70 and the train information providing device 70*a*. Besides, for example, each of the interface 28 and the interface 28*a* includes a connection port for LAN or RS422, although the configuration is not limited to those cases.

In an identical manner to the third embodiment, the support device 20*a* installed in each train car can import the train classification information 1D and the control information 2D through the transmission path 100. Thus, in each train car, the operation determining unit 23*a* can determine whether the corresponding train car is within the platform train-car capacity 205 and output the determination result on the passenger compartment indicator 71*a*.

As described above, according to the support device 20 and the support device 20*a* in the fourth embodiment, the control information 2D having the revised codes is transmitted to the support device 20*a* installed in each train car when the train A passes over the transponder 12. Thus, even if train traffic rescheduling is performed just before a train makes a stop and even if the crew member is not in a position to direct the passengers in a swift manner, the door opening side can be notified in an automatic manner.

Meanwhile, in place of the train information providing device 70 and the passenger compartment indicator 71, an indicator light can be installed on the cab for notifying the door opening side 204. By connecting the interface 28 to that indicator light, the crew member can easily determine the door opening side upon receiving the control information 2D.

INDUSTRIAL APPLICABILITY

In this way, the present invention is applicable to a support device for supporting train crew in performing a door opening-closing operation and is particularly suitable as an invention for obtaining information regarding the door opening side in a prompt manner without having to install ground devices.

The invention claimed is:

1. A train crew support device equipped with a door opening-closing signal output unit for controlling a door opening-closing device of a train in response to a door opening-closing operation performed by a crew member, the train crew support device comprising:

a train classification information interface that imports train classification information that includes a station code indicating a stop, a track code indicating a train track, platform information indicating a platform direction, a door opening-closing side, and a platform train-car capacity;

an automated train supervision (ATS) interface that imports, from an ATS system, ATS control information that includes a line code indicating a travelling line of a train, a station code, and a track code;

a memory unit that stores the train classification information; and an operation determining unit that checks the line code, the station code, and the track code included in the ATS control information against the train classification information, identifies a door opening side of a corresponding train based on the check by the operation determining unit, and outputs a door opening-closing signal to the door opening-closing signal output unit.

2. The train crew support device according to claim 1, wherein the ATS control information is individual information regarding a warning aspect which incorporates the line code, the station code, and the track code.

3. The train crew support device according to claim 2, wherein the operation determining unit includes a transmitting unit for receiving the ATS control information and the train classification information through a transmission path laid across train cars, and outputs the door opening-closing signal based on a platform train-car capacity and a number of train cars.

4. The train crew support device according to claim 3, wherein the operation determining unit includes a train information providing device interface that outputs information, which indicates a door opening side, to a train information providing device connected to an indicator in the corresponding train, and outputs the door opening-closing signal to the train information providing device interface.

5. The train crew support device according to claim 4, wherein the train information providing device interface outputs the door opening-closing signal to a door opening side indicator light installed on a cab.

6. The train crew support device according to claim 1, wherein the ATS control information is individual information regarding a stop aspect which incorporates the line code, the station code, and the track code.

7. The train crew support device according to claim 6, wherein the operation determining unit includes a transmitting unit for receiving the ATS control information and the train classification information through a transmission path laid across train cars, and outputs the door opening-closing signal based on a platform train-car capacity and a number of train cars.

8. The train crew support device according to claim 7, wherein the operation determining unit includes a train information providing device interface that outputs information, which indicates a door opening side, to a train information providing device connected to an indicator in the corresponding train, and outputs the door opening-closing signal to the train information providing device interface.

9. The train crew support device according to claim 8, wherein the train information providing device interface outputs the door opening-closing signal to a door opening side indicator light installed on a cab.

10. The train crew support device according to claim 1, wherein the operation determining unit includes a transmitting unit for receiving the ATS control information and the train classification information through a transmission path laid across train cars, and outputs the door opening-closing signal based on a platform train-car capacity and a number of train cars.

11. The train crew support device according to claim 10, wherein the operation determining unit includes a train information providing device interface that outputs information, which indicates a door opening side, to a train information providing device connected to an indicator in the corresponding train, and outputs the door opening-closing signal to the train information providing device interface.

12. The train crew support device according to claim 11, wherein the train information providing device interface outputs the door opening-closing signal to a door opening side indicator light installed on a cab.

* * * * *